US005611892A

United States Patent [19]

Karvinen et al.

[11] Patent Number: 5,611,892

[45] **Date of Patent: *Mar. 18, 1997**

[54] COMPACT PRESS SECTION IN A PAPER MACHINE

[75] Inventors: Mikko Karvinen, Vihtavuori; Reima Kerttula, Muurame; Jorma Laapotti, Palokka; Juhani Pajula, Jyvaskyla, all of Finland

[73] Assignee: Valmet Corporation, Helsinki, Finland

[ * ] Notice: The term of this patent shall not extend beyond the expiration date of Pat. No. 5,240,563.

[21] Appl. No.: 319,164

[22] Filed: Oct. 6, 1994

Related U.S. Application Data

[63] Continuation-in-part of Ser. No. 25,190, Mar. 2, 1993, Pat. No. 5,393,383, which is a continuation-in-part of Ser. No. 829,989, Feb. 3, 1992, Pat. No. 5,240,563.

[30] Foreign Application Priority Data

Dec. 19, 1991 [FI] Finland ..... 916026

[51] Int. Cl.[6] ..... D21F 3/04

[52] U.S. Cl. ..... 162/205; 162/193; 162/359.1; 162/360.3; 162/275

[58] Field of Search ..... 162/274, 275, 162/358.1, 358.2, 359.1, 360.2, 360.3, 193, 194, 205; 34/117, 120

[56] References Cited

U.S. PATENT DOCUMENTS

| | | | |
|---|---|---|---|
| 3,185,617 | 5/1965 | Justus | 162/274 |
| 3,198,694 | 8/1965 | Justus | 162/272 |
| 3,285,806 | 11/1966 | Justus et al. | 162/306 |
| 3,861,997 | 1/1975 | Ely | 162/360 |
| 4,359,827 | 11/1982 | Thomas | 34/16 |
| 4,359,828 | 11/1982 | Thomas | 34/114 |
| 4,483,745 | 11/1984 | Wicks et al. | 162/205 |
| 4,526,655 | 7/1985 | Karvinen et al. | 162/360.1 |
| 4,648,942 | 3/1987 | Wanke et al. | 162/286 |
| 4,889,598 | 12/1989 | Niskanen | 162/199 |
| 4,919,762 | 4/1990 | Laapotti et al. | 162/360.1 |
| 4,931,143 | 6/1990 | Karvinen et al. | 162/360.1 |
| 4,935,098 | 6/1990 | Snellman et al. | 162/273 |
| 4,943,351 | 7/1990 | Wedel | 162/205 |
| 4,976,821 | 12/1990 | Laapotti | 162/360.1 |
| 5,021,124 | 6/1991 | Turtinen et al. | 162/281 |
| 5,022,163 | 6/1991 | Ilvespaa et al. | 34/23 |
| 5,037,509 | 8/1991 | Wedel | 162/286 |
| 5,049,239 | 9/1991 | Autio | 162/274 |
| 5,240,563 | 8/1993 | Karvinen et al. | 162/360.3 |
| 5,393,383 | 2/1995 | Karvinen et al. | 162/360.3 |

FOREIGN PATENT DOCUMENTS

| | | | |
|---|---|---|---|
| 0107606 | 5/1984 | European Pat. Off. . | |
| 0348373 | 12/1989 | European Pat. Off. . | |
| 0496965 | 8/1992 | European Pat. Off. . | |
| 82500 | 8/1986 | Finland . | |
| 885737 | 6/1990 | Finland . | |
| 2656012 | 6/1991 | France . | |
| 3515575 | 11/1985 | Germany . | |
| 3831429 | 3/1989 | Germany . | |
| 2269893 | 11/1990 | Japan . | |
| 697774 | 9/1953 | United Kingdom | 162/360.1 |

*Primary Examiner*—Karen M. Hastings
*Attorney, Agent, or Firm*—Steinberg, Raskin & Davidson, P.C.

[57] ABSTRACT

A closed press section in a paper machine including a compact combination of press rolls, some of which define press nips with each other between which the web has a closed draw supported by the face of a fabric. The press section has a center roll in connection with which at least one press nip is formed. A closed loop of a transfer band is passed around the center roll. The web is transferred on an outer face of the transfer band after the last press nip in the compact combination of rolls as a closed and constantly supported draw onto a drying wire in a drying section following after the press section. The transfer band loop is preferably made of a fabric that substantially does not receive water and does not rewet the web. The web-adhesion properties of the outer face of the transfer band are chosen so that, after the last nip, the web follows the transfer band, and so that the web can be transferred as a fully closed draw onto the drying wire. In connection with the loop of the transfer band, means for conditioning/cleaning the band and/or safety devices are provided, by whose means an adequate operation of the transfer band is maintained.

13 Claims, 6 Drawing Sheets

COMPACT PRESS SECTION IN A PAPER MACHINE

This application is a continuation-in-part of U.S. Ser. No. 08/025,190 filed Mar. 2, 1993 now U.S. Pat. No. 5,393,383, which in turn is a continuation-in-part of U.S. Ser. No. 07/829,989 filed Feb. 3, 1992, now U.S. Pat. No. 5,240,563.

BACKGROUND OF THE INVENTION

The invention relates to a closed press section in a paper machine, comprising a compact combination of press rolls in which some of the rolls form press nips with each other. The web has a closed draw between the press nips and is supported on a face of at least one fabric. The press section further comprises a center roll, in connection with which at least one press nip is formed. A closed loop of a transfer band is passed around the center roll. The web is transferred on an outer face of the transfer band after the last press nip in the compact combination of rolls, as a closed and constantly supported draw onto a drying wire or an equivalent fabric in the drying section following the press section.

The invention also relates to a method for dewatering a web in a press section in a paper machine including a compact combination of press rolls having at least one press nip defined between a center roll and a first press roll and a plurality of fabrics for supporting a web in its run through the press section.

A particular problem in prior art press sections in paper machines is caused in the area in which a web that has passed through the nips in the press section is detached from a smooth-faced roll in the press, in particular from the center roll, and transferred to the drying section of the paper machine. This problem is accentuated with increasing running speeds of paper machines and/or when the paper web is very weak, e.g. when a maximal bulk is desired. In such a case, the pressing is carried out with very low nip loads, and the wet strength of the web remains low. Problems arise when the web is separated from the smooth-faced roll because a high tensile strain is applied to the web. Other problems arise in the area where the web is transferred from the press section to the drying section and it must run a short distance as a free and unsupported draw unsupported by a roll face or by a fabric. When the running speed of the paper machine is increased, there is a high risk that the paper web will be torn in these problem areas.

In conventional press sections, the web should preferably be detached from the center roll so that it runs to the drying section in a run which is as straight as possible. In this preferred situation, the area of transfer of the web from the press section to the drying section has constituted a significant bottleneck in attempts to increase the running speed of the paper machine.

In prior art press sections, attempts have been made to solve the problems discussed above, e.g., by means of the press sections described in U.S. Pat. Nos. 4,359,827 and 4,359,828. In the press sections described in these patents, the web is not placed in direct contact with a face of a center roll in the press section, but a porous belt carries the web around the center roll. The belt corresponds to the length of the roll, i.e., to the working width of the machine, and while guided by guide rolls, supports the web thereon during the transfer run from the press section to the drying section. However, it is a substantial drawback of the press sections in these U.S. patents that the porous band utilized therein loses some of its porosity in the nips in the press section, in which it is compressed to some extent. It is a second substantial drawback in these press sections that, at high temperatures, the band may lose most of its porosity, and in some extreme cases it may even melt.

Attempts are also made in the prior art to employ high temperatures in the press section in order to intensify the dewatering. It is a further drawback in the press sections of the above-referenced U.S. patents that the possibility of cleaning the porous belt is very poor. In the nips in the press section, the pores in the belt tend to be blocked, and the descriptions in these U.S. patents do not teach or suggest any means for conditioning and cleaning the band.

In Finnish Patent Application No. 885737 (filed Dec. 9, 1988), attempts have been made to provide a solution by whose means the drawbacks described above are avoided. The embodiments described in that patent application permit an increased running speed of a paper machine and ensures a problem-free transfer of the web from the press section to the drying section. In view of achieving the above, in these patent application, an endless metal band is passed over the center roll. The metal band is formed as a closed loop by means of guide and tensioning rolls and the closed loop is passed from the center roll to the beginning of the drying section. Thus, the web is transferred from the press section to the drying section while supported by this closed loop.

It is general aim among those skilled in the art to improve the dewatering capacity of presses in the press section of a paper machine. If the moisture content of a paper web can be minimized in the press section, this results in considerable economies in the costs of paper manufacture, because the less wet the paper web is when it arrives in the dryer section from the press section, the lower the amount of energy consumed in the drying section. It can be considered a rule of thumb that, if the moisture content of the web in the press section can be lowered by one percentage unit, the consumption of energy in the drying section is about four percent lower, which translates to considerable economies in cost. The dewatering capacity is generally improved by raising the pressing temperature of the paper web.

In the constructions commonly employed in prior art press sections, the center roll in the press constitutes an object of development. This is because of the material of the center roll which is commonly some suitable rock, for example granite. It is well known that rock rolls are quite sensitive to extensive and sudden changes in temperature, and the effects of such changes may be quite detrimental to the smooth operation of the paper machine. Attempts have been made to develop suitable substitutes for granite rolls. However, it is difficult to make a suitable face for a center roll, and, moreover, the making of the face restricts the choice of the material for the rest of the roll.

In addition, different paper qualities require a different coating and frequently also a different process for the manufacture of the roll coating. Often, it is necessary to manufacture different paper qualities out of different raw materials by means of the same paper machine. A change in quality would also require change of center roll or at least of its coating. A center roll is, however, an expensive and heavy component, and its replacement requires a long and costly standstill of the paper machine.

If a center roll is provided, e.g., with a welded coating or if the coating is elastic, such as rubber-like, the device intended for heating of the paper web must necessarily be placed above the web if it is desirable to provide such a heating device in the construction before an additional press nip in the press not formed against the center roll. However, before the additional press nip in the press, there is hardly any space available for an efficient device that raises the temperature of the web and regulates the temperature profile. It is a drawback of a heater placed in this location that it causes contaminants to gather and fall down onto the paper web.

An attempt has been made partly to solve the problems discussed above by means of the method and the device described in Finnish Patent Application No. 891343 (filed Mar. 21, 1989). In the method described in FI 891343, a transfer band formed as an endless loop by means of tension and guide rolls, is passed over the center roll in the press section. The transfer band extends to outside the area of the press rolls and the paper web is transferred to run onto the transfer band. The paper web is heated in the area of the loop of the transfer band outside the press rolls.

The device in accordance with FI 891343 does not, however, solve the problems discussed above related to the detaching of the paper web from the face of the center roll and to its further transfer.

One particularly difficult problem, which was mentioned above, arises from the fact that different paper qualities are often manufactured by means of the same paper machine, e.g., depending on the market situation, the orders, or on the type of raw material that is available. The center rolls currently in operation and the belt solutions related to them do not permit a rapid and smooth change of paper quality produced by the press section. The change of quality should ideally take place quite rapidly, because any standstill time causes considerable economic losses. In the press sections presented in the prior art, adequate consideration has not been given to quick replacement of the belt running around the center roll or of the other press fabrics and press rolls in the prior art solutions.

Moreover, in prior art center-roll/transfer-belt arrangements, particular attention has not been paid to proper conditioning of the transfer belt running around the center roll or in other respects to safety and optimization of the transfer of the web from the transfer belt.

OBJECTS AND SUMMARY OF THE INVENTION

Accordingly, it is an object of the present invention to provide a compact press section in a paper machine in which, at the same time, some the important problems discussed above are solved.

It is another object of the present invention to provide a new and improved press section which keeps a smooth face of a center roll in the press section clean and free from debris. This object is important in particular when the paper machine produces fine papers.

It is still another object of the present invention to provide a new and improved press section which provides for improved control and regulation of the length in the machine direction of the press zone in the roll nips formed in connection with the center rolls. This object cannot be achieved by means of a metal band running around the center roll, such as in Finnish Pat. Appl. No. 885737.

It is yet another object of the invention to provide a new and improved arrangement in which the web is prevented from remaining on the transfer band and travelling around the transfer band loop and the surface of the transfer band is cleaned after the web has been detached therefrom.

In view of achieving the objects stated above and others, in the present invention, a transfer band runs around the center roll and preferably comprises a transfer band fabric that substantially does not receive water and does not rewet the web. The web-adhesion properties of an outer face of the transfer band fabric are selected so that, after a last press nip formed against the center roll (in the running direction of the transfer band), the web follows the transfer band fabric, and is transferred as a fully closed draw onto the drying wire or onto an equivalent fabric that carries the web further.

Further, in the present invention, in connection with the loop of the transfer band fabric, means for conditioning the band and/or safety devices are provided. The conditioning means provide and maintain an adequate operation of the transfer band fabric.

In a press section in accordance with the invention, as the transfer band, a transfer band fabric is used that does substantially not receive water, so that the web is not rewetted when it is transferred on the outer face of the transfer band fabric between the nips and from the last nip onto the drying wire or equivalent. The transfer band fabric is preferably made as a multi-layer structure so that the choice of the material for its outer face provides suitable properties of adhesion to the web and the web can be made to follow the transfer band fabric after the last press nip. On the other hand, the material is selected so that the web can be detached from the band in the transfer zone without problems and transferred onto the drying wire, e.g., as a suction-roll transfer. The structure and the materials of the transfer band fabric are chosen while also taking into account the properties of cleaning, conditioning, the mechanical strength properties, and the elastic properties of the band.

By means of the selection of the thickness and the elasticity of the transfer band fabric, it is also possible to control the length in the machine direction of the nip zones in the roll nips formed in connection with the center rolls and, thereby, the process of pressing in the roll nips.

It is an important feature of the present invention that a relatively inexpensive transfer band fabric also operates as the wearing replacement part which protects the expensive and heavy center roll. Thus, in the invention, the center roll can be manufactured irrespective of its coating, with consideration to the mechanical aspects alone. The transfer-band fabric loop can be arranged to be quickly replaceable, e.g., in connection with any desired change of paper quality being produced in the paper machine. Thus, for each paper quality to be manufactured, it is possible to design and to store exactly the particular sort of transfer band loop that is best suitable for the quality concerned in view of its properties of adhesion, dewatering, etc.

The invention is also related to a frame construction of a press section, preferably arranged so that the center roll is mounted on an intermediate frame part or on the front or rear frame. The front or rear frame is cantilevered in respect of this part and provided with detachable intermediate frame pieces placed in the side frames at the operating side, The center roll is mounted preferably by means of fixed bearing supports. The transfer-band fabric loop is thus quickly replaceable after opening the intermediate frame pieces.

Moreover, in the press section, quick replacement of the press rolls and the other fabrics can be arranged favorably by lifting the press rolls straight upwards, e.g., by means of a crane mounted on the ceiling, without difficult operations of shifting to the side, This is achieved by making the frame part open at the top and/or partly openable at the top by shifting the press rolls from above the center roll to the side by means of intermediate frame parts.

In the invention, it is preferable to provide the transfer fabric loop with a cleaning and safety arrangement, by whose means it is possible to prevent the web from running around the transfer band loop as a result of an unsuccessful web transfer. This undesirable running would form a web layer that destroys the fabrics on the face of the transfer band loop. The cleaning and safety arrangement may comprise doctors and water jets operating upon the transfer band as it runs over a driven belt leading roll after the web is supposed to be transferred and also as the transfer band runs over a tensioning roll.

The transfer band may be impermeable or permeable to some extent. When a permeable transfer band is used, it is preferable to use a hollow-faced center roll whereas in connection with an impermeable belt, it is preferable to use a smooth-faced center roll, such as a roll with a cast-iron body.

The method of the invention for dewatering a web in a press section in a paper machine including a compact combination of press rolls having at least one press nip defined between a center roll and a first press roll and a plurality of fabrics for supporting a web in its run through the press section, includes carrying the web on an outer face of a transfer band defining a closed loop around the center roll. The transfer band comprises a fabric which substantially does not receive water and does not rewet the web. A suction roll is arranged after the at least one press nip in the running direction of the transfer band and the web is transferred from the transfer band after the at least one press nip in a transfer zone in proximity to the suction roll as a fully closed draw. The outer face of the transfer band is doctored to prevent the web from remaining on the transfer band after the transfer zone and clean the outer face of the transfer band.

In preferred embodiment of the invention, the transfer band is passed over a second press roll, the outer face of the transfer band is doctored by means of a doctor as it runs over the second press roll, and a lubricating/washing jet is directed at the transfer band in proximity to and before the doctor in the running direction of the transfer band. A third press roll may be arranged a distance from the second press roll in a position to provide a large wrapping angle of the transfer band about the second press roll. In addition, the transfer band may be passed over a tensioning roll after the web has been removed therefrom, the outer face of the transfer band is doctored by means of a doctor as it runs over the tensioning roll, and a lubricating/washing jet is directed at the transfer band in proximity to and before the doctor in the running direction of the transfer band.

In another embodiment of the invention, a hollow-faced center roll is used in combination with a transfer band fabric which is slightly water-permeable. A spray of lubricant, i.e., water, may be applied to the outer surface of the hollow-faced center roll on a sector free form the transfer band to prevent "water bags" from forming in front of the nips. The contact angle between the transfer suction roll onto which the web is transferred from the transfer band and the transfer band is adjusted to accommodate the different modes of operation of the paper machine, e.g., threading or continuous running.

Means may be provided to cause the paper web to adhere to the face of the first drying cylinder in a drying section following the press section until the web reaches the doctor arranged in operative relationship with the drying cylinder. This is important in order that narrow leaders, separated from the web by water jets in the wire section or on the lower surface of the pick-up felt, may be appropriately guided to the drying section. These means may comprise heat applied to the first drying cylinder to increase adhesion of the web thereto or chemicals and/or water sprayed onto the face of the first drying cylinder to control adhesion of the web thereto.

In the following, the invention will be described in detail with reference to some exemplifying embodiments of the invention shown in the figures in the accompanying drawings. However, the invention is in no way strictly confined to the details of these embodiments.

BRIEF DESCRIPTION OF THE DRAWINGS

The following drawings are illustrative of embodiments of the invention and are not meant to limit the scope of the invention as encompassed by the claims.

FIG. 3A shows a hollow-faced roll as the center roll of the press.

FIG. 3B shows a variation in which the pick-up felt operates as the press felt in all of the three subsequent press nips in the press section.

FIGS. 3C, 3D and 3F show different variations of the accomplishment of the closed draw of the web by means of a transfer fabric in accordance with the invention and a suction-transfer roll onto the drying wire of the drying section.

FIG. 3G shows different safety and conditioning arrangements for the transfer fabric loop in accordance with the invention.

FIG. 3H shows an arrangement of cleaning and heating of the transfer fabric loop in accordance with the invention.

DETAILED DESCRIPTION OF THE INVENTION

Figure 1:
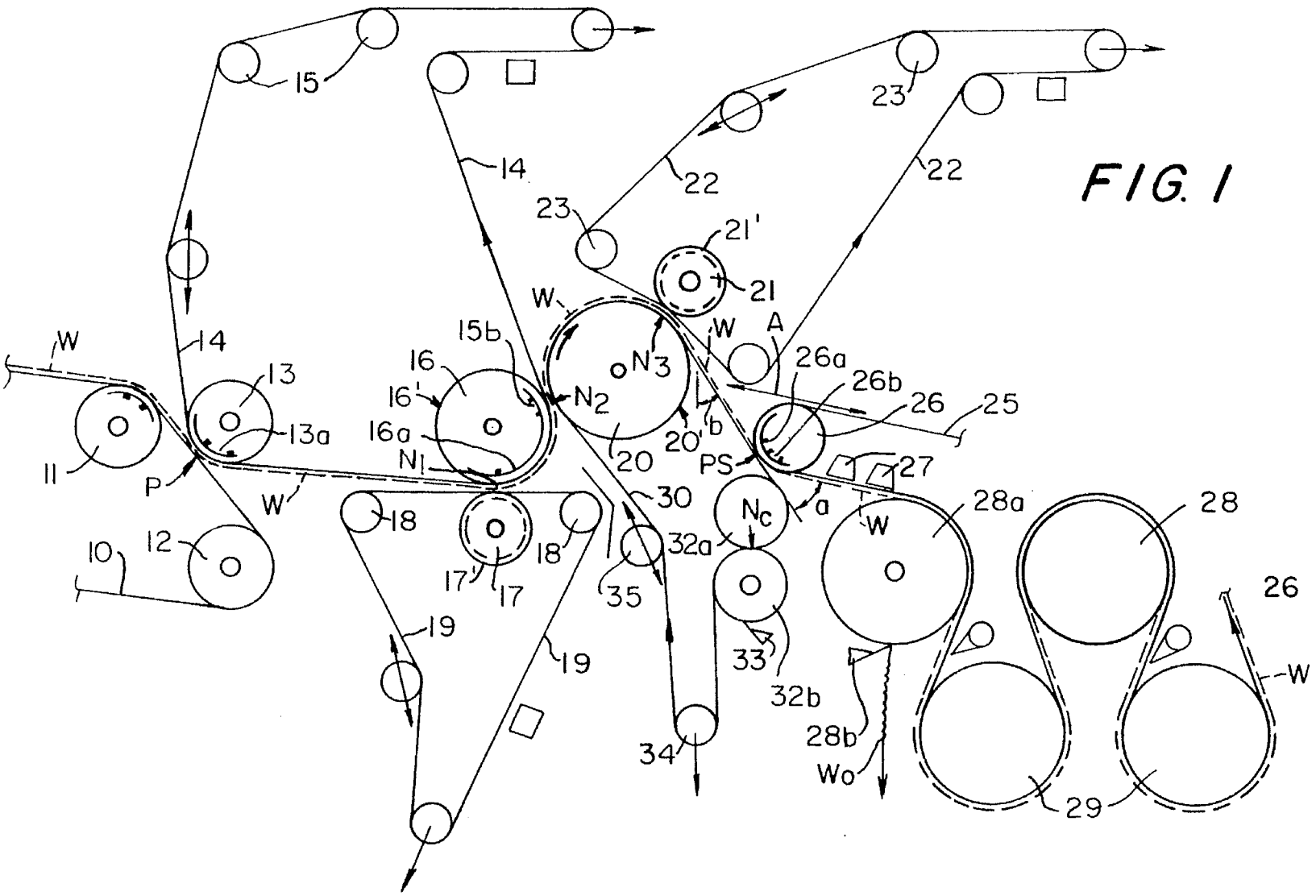
FIG. 1 is a schematic side view of a first embodiment of a press section in accordance with the invention.

FIG. 1 is a schematic side view of a preferred press section in accordance with the invention, whose basic construction is the assignee's Sym-Press-II™ press section. A paper web W is drained on a forming wire 10. The web W is transferred at a pick-up point P on the forming wire 10 between a suction roll 11 and a drive roll 12 onto a pick-up fabric 14 with the aid of the negative pressure in suction zone 13*a* of a pick-up roll 13.

The web W is transferred on the lower face of the pick-up felt 14 into a first dewatering press nip $N_1$. This nip $N_1$ is a two-felt nip formed between a lower, hollow-faced 17' press roll 17 and an upper suction roll 16. A lower felt 19 runs through nip $N_1$ which is arranged to remove water from the web which is guided by guide rolls 18. After the nip $N_1$, with the aid of the negative pressure effective through perforations 16' in suction zone 16a of the suction roll 16, the web W follows the pick-up felt 14 and is transferred on its face into a second press nip $N_2$. The pick-up felt 14 acts as a press fabric in nip $N_2$ and receives water.

In the area of the second nip $N_2$, the suction roll 16 has a second suction zone 16b, after which after which the web W follows a face of the transfer band fabric 30. The transfer fabric 30 is arranged in accordance with the invention and runs around a center roll 20 in the press. In this embodiment, the center roll 20 preferably is provided with a smooth cylindrical mantle. Fabric 30 has such properties of adhesion to the web so that the web is detached from the face of the pick-up felt 14 after the nip $N_2$ and follows the face of the transfer band fabric 30. The web is then transferred on the face of the transfer fabric 30 into a third press nip $N_3$. In the transverse direction, the transfer band fabric 30 extends substantially over the entire length of the center roll 20 and slightly beyond the web W width.

The nip $N_3$ is formed between the center roll 20 and a hollow-faced 21' press roll 21. A press felt 22 runs through the nip $N_3$ while being guided by guide rolls 23. After the nip $N_3$, the web W follows the outer face of the transfer band fabric 30, which face is more adhesive to the web W than the face of the press felt 22. On the downwards inclined straight run of the fabric 30, the web W is transferred without substantial rewetting and as a fully closed and constantly supported draw, onto the drying wire 25 in the drying section. This transfer is a substantially non-rewetting transfer.

The transfer band fabric 30 and a transfer suction roll 26 form a transfer zone PS, in whose area the web W is transferred onto the drying wire 25 aided by a first suction zone 26a of the transfer suction roll 26, in which zone the negative pressure is higher than in the subsequent second suction zone 26b. This feature is explained in greater detail with reference to FIG. 1A. The different negative pressures in the suction zones ensures that the web W remains on the face of the drying wire 25. The web W is kept on the straight run of a drying wire 25 after the transfer suction roll 26 on the lower face of the drying wire 25 with the aid of the field of negative pressure produced by suction boxes 27. The web is then transferred onto a first heated drying cylinder 28a. From the drying cylinder 28a, the web W follows the drying wire 25 over suction cylinders 29 and continues further as a single-wire draw through the first drying group in the drying section.

After the transfer zone PS, the transfer band fabric runs through a safety and conditioning nip $N_c$ formed by rolls 32a and 32b. Of these rolls, the lower one 32b is provided with a drive gear, and on its lower face there is a doctor 33 which keeps a face of the roll 32b clean. The operation of the nip $N_c$ will be discussed in more detail later in connection with the description related to FIG. 3G. After the roll 32b, the run of the transfer band fabric 30 continues to a tensioning roll 34 which turns the run of the transfer band loop upwards to guide roll 35. From guide roll 35, the transfer band fabric 30 runs further as a straight run into the second nip $N_2$.

Figure 1A:
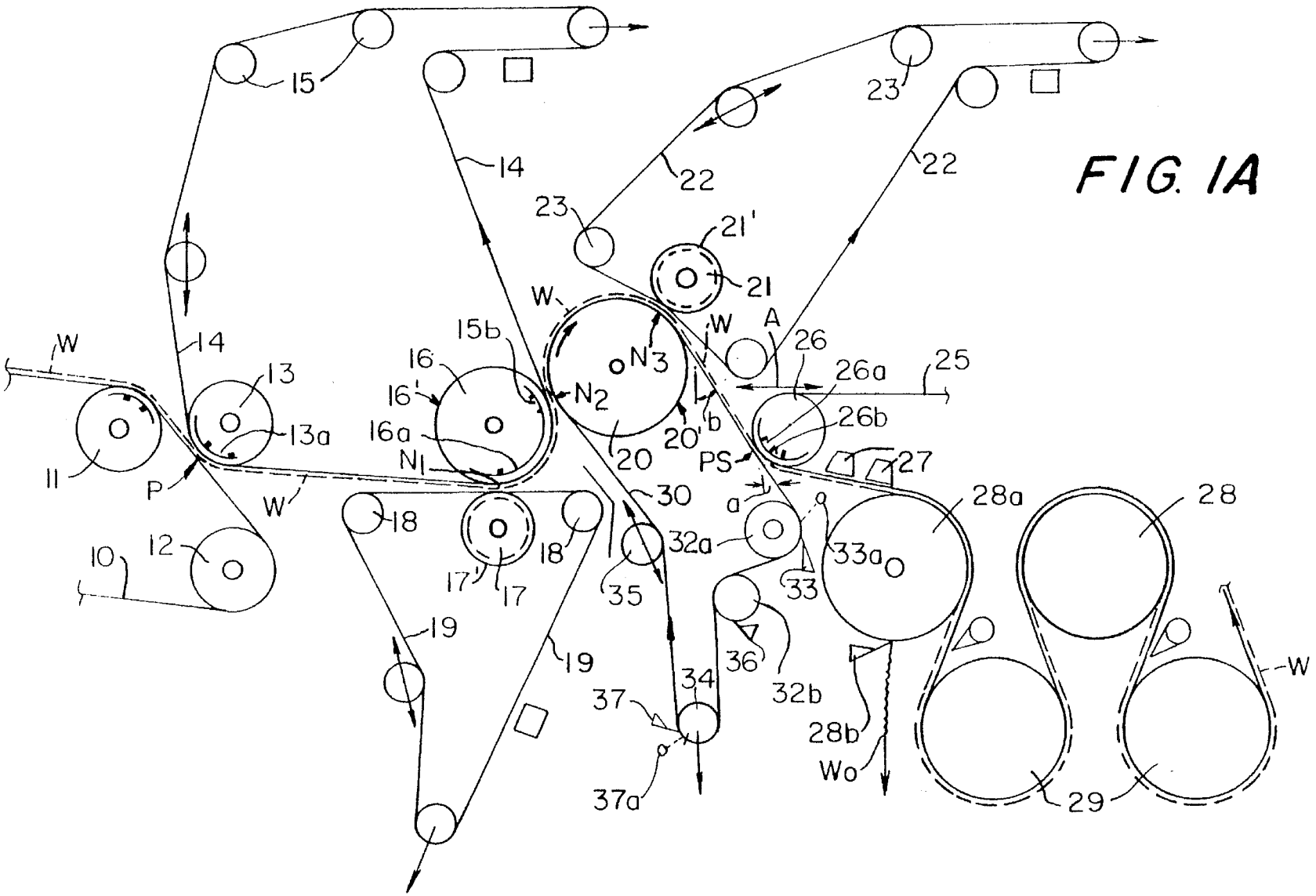
FIG. 1A is a schematic side view of a second embodiment of a press section in accordance with the invention.

The embodiment shown in FIG. 1A is substantially similar to that shown in FIG. 1 and the same reference numerals denote the same elements. However, in the embodiment of FIG. 1A, after the transfer zone PS, the transfer band fabric does not run through a safety and conditioning nip $N_c$ as shown in FIG. 1. Rather, different safety and conditioning means are provided for preventing the paper web, or remnants thereof, from travelling around the transfer band loop and cleaning the surface of the transfer band. These means may comprise doctors and washing jets.

Specifically, as shown in FIG. 1A, a roll 32a is arranged after the transfer zone PS and the transfer suction roll 26. Roll 32a is a driven belt leading roll provided with a drive gear. The desired tension in the transfer band 30 against the transfer suction roll 26 is maintained by means of the driven leading roll 32a. Also, the transfer band 30 forms a contact angle ("wrap angle") with the transfer suction roll 26 which is preferably between about 2° and about 20°. A doctor 33 is arranged to act against the transfer band as it runs over roll 32a to prevent the paper web from travelling around the transfer band loop and also to clean the transfer band. The web is scraped off the transfer band 30 by means of the doctor 33, e.g., if the suction roll 26 fails to transfer the web to the drying wire 25. A washing/lubricating jet device 33a is arranged before the doctor 33 in the running direction of the transfer band and operates to provide a jet which washes and lubricates the transfer band thereby reducing wear of the transfer band and the doctor 33 and makes the cleaning operation provided by the doctor 33 more efficient. The device 33a is preferably provided with spreading nozzles through which a substance such as water is sprayed onto the transfer band fabric.

After the roll 33a, the run of the transfer band 30 continues to roll 32b which is spaced from roll 33a so as not to form a nip therebetween. A doctor 36 operates against the lower surface of the roll 32b to remove broke from the surface of the roll 32b and, if needed, to prevent the web from wrapping around roll 32b. By selectively arranging the position of the roll 32b relative to roll 32a, the transfer band 30 will have a sufficiently large wrapping angle $\alpha$ around the roll 33a which enables an adequate driving power to be conveyed to the transfer band 30.

After the roll 32b, the run of the transfer band fabric 30 continues to a tensioning roll 34 which turns the run of the transfer band loop upwards to guide roll 35. From guide roll 35, the transfer band fabric 30 runs further as a straight run into the second nip $N_2$.

A doctor 37 is arranged to act against the tensioning roll 34 to clean the transfer band 30 and wipe the transfer band 30 dry before the transfer band 30 is passed into the press nips. A washing/lubricating jet device 37a is arranged before the doctor 37 in the running direction of the transfer band 30 and operates to provide a jet which washes and lubricates the transfer band. The device 37a may include means for directing an oscillating high-pressure needle jet or a high-pressure jet derived from with spreading nozzles which spray a cleansing substance onto the transfer band. Although the jet usually consists of water, it is also possible to use chemicals in the jet to aid in the cleansing and conditioning of the transfer band 30.

The transfer suction roll 26 in the embodiment of FIG. 1A is constructed so as to enable variable negative pressures to be applied therein. For example, during threading operations, a suction zone in the transfer suction roll 26 is provided with a relatively high negative pressure, e.g., in the order of about 15 kPa to about 50 kPa (0.15 bars to 0.50 bars). During continuous running, when the web is on the transfer band 30 and is being transferred to the dryer section, the negative pressure effective in the suction zone is adjusted to be very low, e.g., in the order of about 0.01 kPa to about 0.10 kPa (0.0001 bars to 0.0010 bars). By adjusting the negative pressure in this manner, wear of the web caused by speed differences is substantially avoided and also marking of the web caused by the drying wire is avoided. If the transfer suction roll 26a has only one suction zone, the above adjustment of negative pressure is applied in that zone. If the transfer suction roll 26a has more than one suction zone, the above adjustment of negative pressure is preferably applied in the first zone whereas the pressure in the subsequent zones and/or the last zone may be low, e.g., in the order of about 0.01 kPa to about 0.10 kPa.

Figure 2:
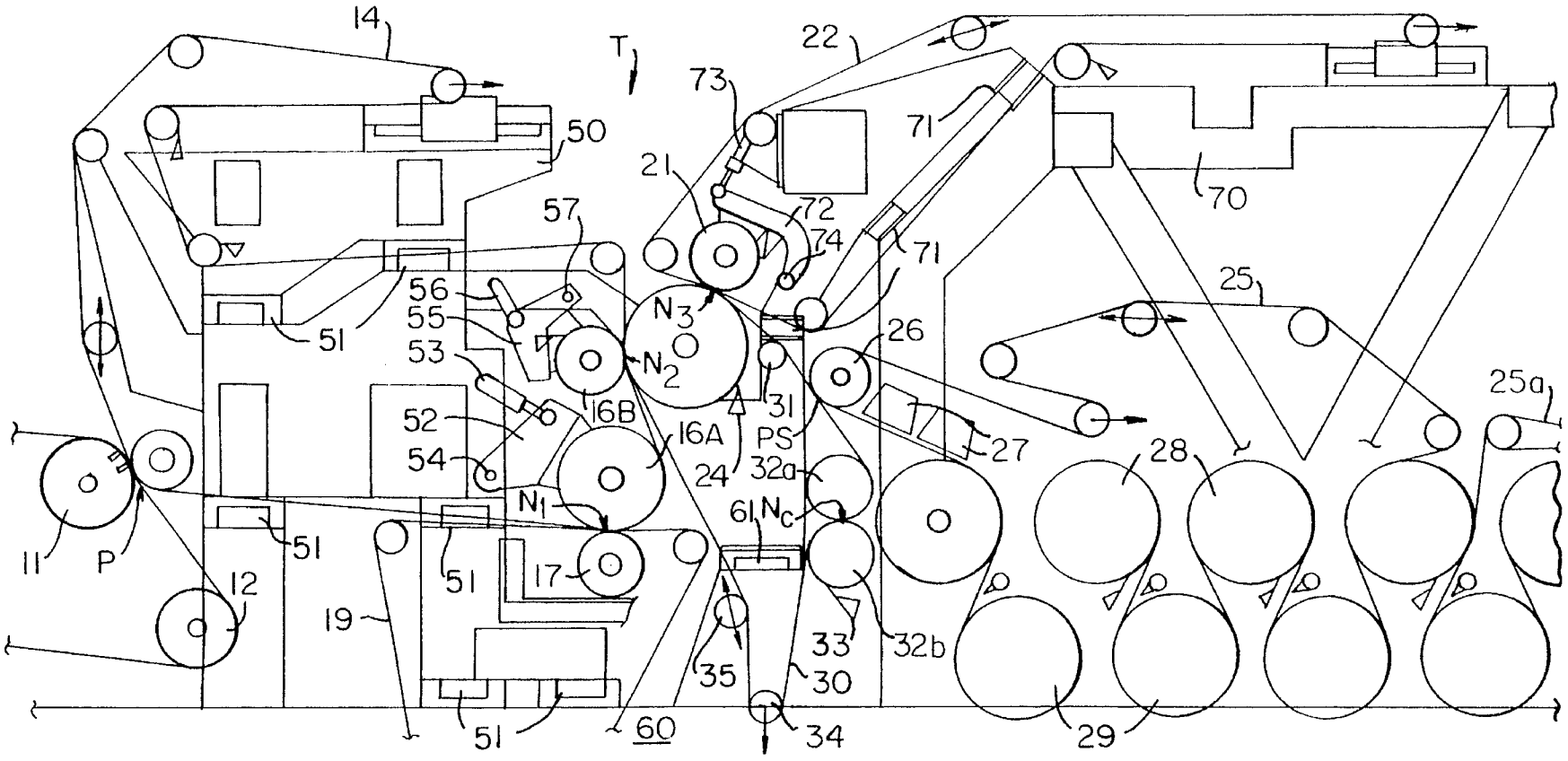
FIG. 2 shows a third version of the invention schematically showing the frame constructions of the press section related to the present invention.

FIG. 2 illustrates an application of the invention to the assignee's Sym-Press-O™ press section. FIG. 2 also shows the frame constructions of the press section, because they are in certain respects related to the inventive idea of the present invention. In the following, those features of construction of a press section as shown in FIG. 2 which are different from that described above in respect of FIGS. 1 and 1A will be discussed.

In the press section shown in FIG. 2, the first nip $N_1$ is formed between a lower roll 17 and an upper press-suction roll 16A. The press roll 16A does not form a press nip with the center roll 20. Rather, the web W is transferred from the suction zone of the roll 16A on the pick-up fabric 16 as an upwards directed straight run into the second nip $N_2$, which is formed between the center roll 20 and a hollow-faced press roll 16B. Thus, differing from FIG. 1, after the third nip $N_3$, the run of the transfer band fabric 30 is guided by a guide roll 31. After guide roll 31, the web W is transferred on the transfer zone PS, where the web W is transferred onto the drying wire 25. A cleaning doctor is arranged on the lower sector of the center roll 20 that is free from the fabric loop 30. The press section as shown in FIG. 2 is advantageous especially when it is necessary to regulate the nip loads within wide limits, because in all the nips $N_1$, $N_2$ and $N_3$, it is possible to employ variable-crown rolls 17, 16*b* and 21.

In the following, the press frame construction shown in FIG. 2 will be described in the respects in which it is related to the present invention. The press section comprises a front frame 50 and a rear frame 70, between which there is a space T. Space T is open at the top or, alternatively, is arranged so that it can be opened quickly. Through space T, the press rolls in the compact combination of rolls, as well as the upper fabrics 15 and 22, can be replaced quickly without disassembly of the frame parts.

Press roll 16B, which forms the second nip $N_2$, is mounted on loading arms 55 which are attached to the front frame 50 by means of horizontal articulated joints 57. Press roll 16B is pivoted by means of a power unit 56 for the purpose of loading and opening of the second nip $N_2$ so that a space is opened above the lower press roll 16A and the center roll 20 for their replacement. This replacement takes place upwards through the open or openable space T by means of a crane mounted on the ceiling.

In a corresponding manner, the press roll 21 is mounted on loading levers 72 which are attached by means of horizontal articulated joints 74 to the front part of the rear frame 70. Press roll 21 is pivoted by means of a power unit 73 for the purpose of loading the nip $N_3$ as well as for shifting the roll 21 aside for replacement of the press rolls placed underneath. This replacement is also carried out through the space T by lifting substantially straight upwards by means of the crane mounted on the ceiling.

The center roll 20 is mounted by means of fixed bearing supports on an intermediate frame 60 which is attached to the rear frame 70 by means of intermediate pieces 71. In accordance with the present invention, the top portion of the intermediate frame 60 is cantilevered and provided with intermediate pieces 61 and 71 for quick replacement of the transfer-band fabric loop 30. This occurs, for example, when the paper quality manufactured by means of the paper machine is changed and when the transfer band fabric 30 is also replaced to comply with the new quality or when a worn transfer band fabric 30 or fabrics is/are replaced. The intermediate frame 60 may also be a part of the front or rear frame 50; 70.

Both the front frame 50 and the rear frame 70 are also cantilevered in a way in itself known and provided with openable intermediate pieces 51, 71 placed at the operating side of their side frames for the purpose of replacement of the upper fabrics 15 and 22.

For replacement of the lower fabric 19 of the first nip $N_1$, the lower part of the front frame 50 is also provided with openable intermediate pieces 51.

FIG. 2 also shows a part of the frame construction of the drying section as well as an initial portion of a second drying wire 25A provided with single-wire draw.

The transfer-band fabric loop 30 extends across the entire width of the web W in the transverse direction. The adhesiveness of the outer face of the transfer band fabric 30 to the web W is chosen so that, after the last nip $N_3$, the web W follows the transfer band fabric 30 without rewetting, and also so that the detaching in the transfer zone PS can be accomplished without disturbances. The transfer band fabric 30 preferably has a multi-layer structure, for example such that it includes a net-like or fibrous fabric, into which an outer-surface layer of suitable adhesiveness and the other layers have been impregnated by means of suitable plastic materials.

With respect to the dimensions and properties of the transfer band fabric 30, the thickness of the transfer band fabric 30 is, e.g., in the range from about 1.5 mm to about 8 mm. The hardness of the outer face of the transfer band fabric 30 is, e.g., in the range from about 1 P&J to about 100 P&J. The thickness and the resilience of the transfer band fabric 30 are chosen so that the length in the machine direction of the nip zones in the nips $N_2$ and $N_3$ through which the transfer band fabric 30 runs is in the range from about 25 mm to about 70 mm when the linear load in the nips $N_2$ and $N_3$ is in the range from about 10 kN/m to about 200 kN/m.

The transfer band fabric 30 is preferably made as a joint-free closed loop, in which case it must be replaced by opening the intermediate piece 61 and 71, and the frame part 60, 70 must be cantilevered. The transfer band fabric 30 may also be made so that it has a joint, in which case the intermediate pieces in the intermediate frame 60 and the cantilevering are unnecessary.

The run of the transfer band fabric 30 from the last nip $N_3$ is preferably such that the straight run of the transfer band fabric 30 or the run guided by the guide roll 31 is at an angle downwards in relation to the vertical plane. Angle b is preferably selected within the range from about 10° to about 50°. In order that the transfer onto the drying wire 25 or an equivalent transfer fabric in the transfer zone PS should be free of problems even at high speeds, the angle a of change in the direction of the web W in the transfer zone PS is arranged as little as possible. Generally, the angle is less than 60°. Most appropriately, the angle a is chosen in the range from about 2° to about 50°.

In a press section in accordance with the invention, the threading of the web W takes place preferably so that the web W is first passed as of full width down from the first drying cylinder 28*a*. The web W to be passed to broke in connection with the threading is detached from the lower face of cylinder 28*a* by means of a doctor 28*b*, and then transferred into a pulper (not shown) in the direction of the arrow $W_0$. Hereupon, in the area of the wire part of the press section 28, from a web W of full width, a narrow leader is cut, which is threaded in a way in itself known through the drying section, whereupon the web W is widened to full width. The web can be passed in full width while being aided by suction transfer rolls 29.

The frame construction shown in FIG. 2 can be applied to any of the above embodiments illustrated in FIGS. 1 and 1A, as well as the embodiment shown in 2A described below.

Figure 2A:
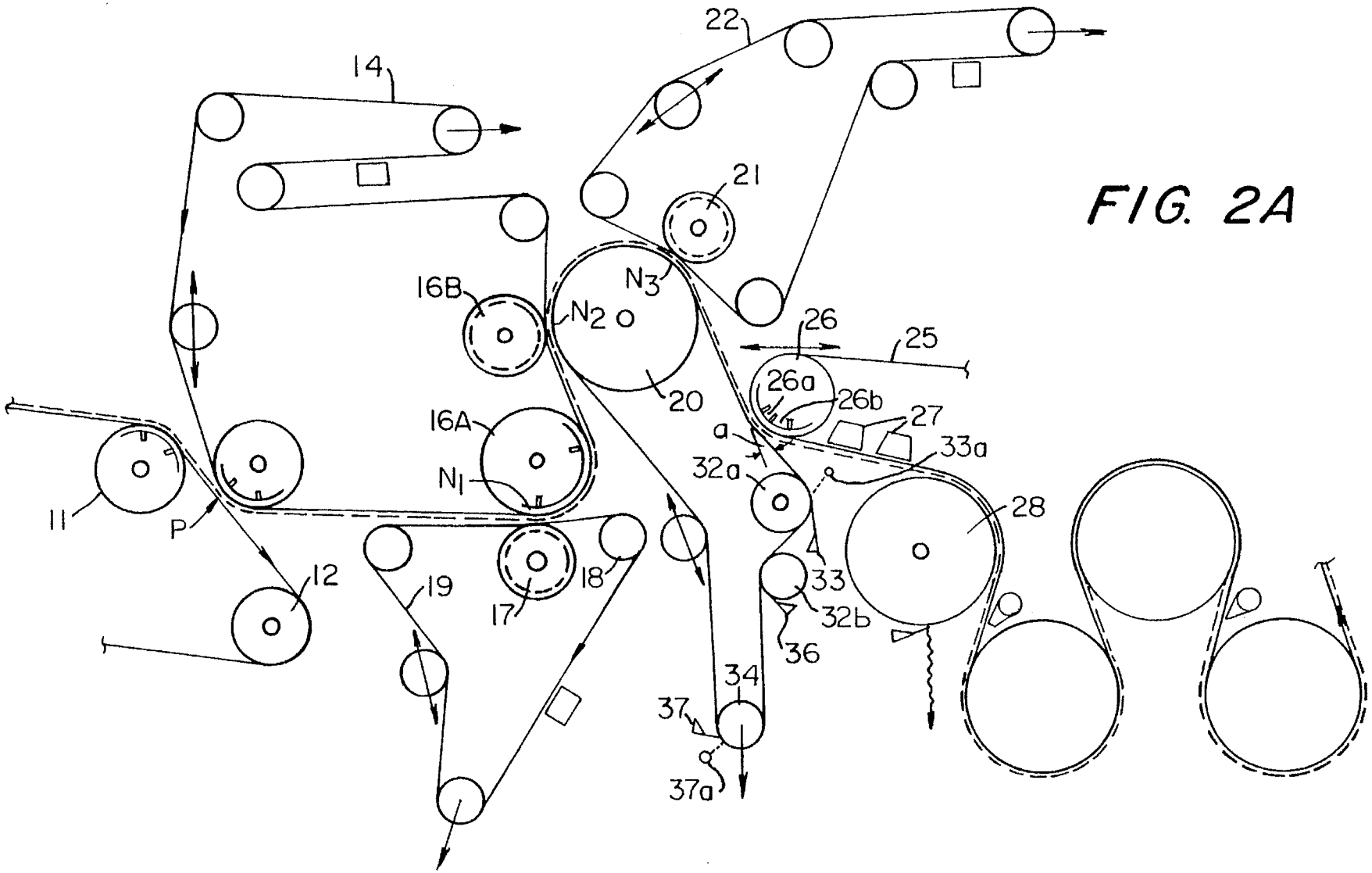
FIG. 2A is a schematic side view of a fourth embodiment of a press section in accordance with the invention.
Figure 2B:
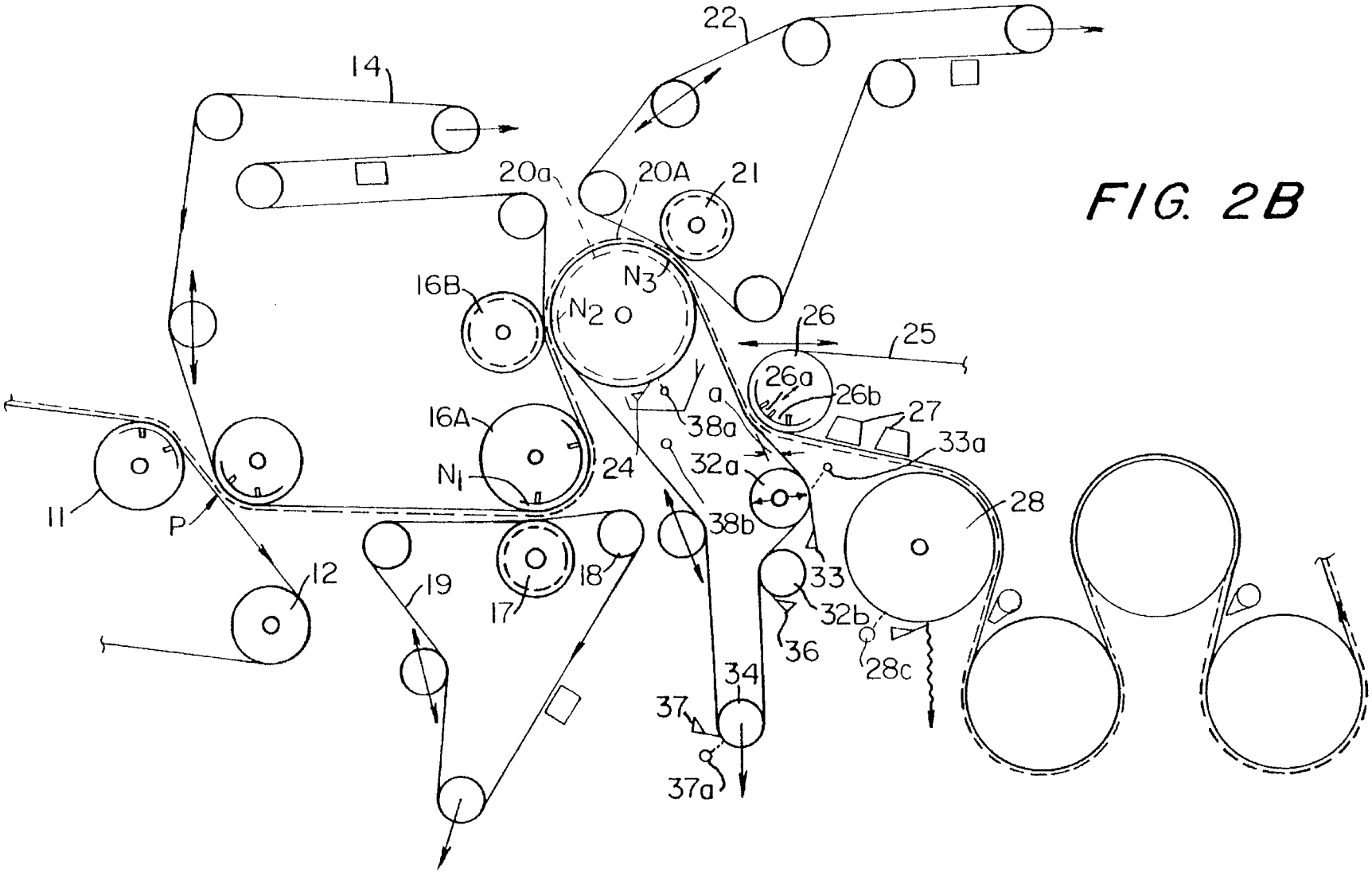
FIG. 2B is a schematic side view of a fifth embodiment of a press section in accordance with the invention.

The embodiments shown in FIGS. 2A and 2B are substantially similar to that shown in FIG. 2 but with the frame construction removed and the same reference numerals denote the same elements. The differences between the press section shown in FIGS. 2A and 2B and that shown in FIG. 2 are similar to those between the embodiments of FIGS. 1 and 1A. Specifically, in the embodiments shown in FIGS. 2A and 2B, after the transfer zone PS, the transfer band fabric does not run through a safety and conditioning nip $N_c$ as shown in FIG. 2. Other safety and conditioning means, such as doctors and lubricating/washing jet devices, are provided for preventing the paper web, or remnants thereof, from travelling around the transfer band loop and for cleaning the surface of the transfer band.

A roll 32*a* is arranged after the transfer zone PS and the transfer suction roll 26. Roll 32*a* is a driven belt leading roll provided with a drive gear. The desired tension in the transfer band 30 against the transfer suction roll 26 is maintained by means of the driven leading roll 32*a*. Also, the transfer band 30 forms a contact angle ("wrap angle") with the transfer suction roll 26 which is preferably between about 2° and about 20°. A doctor 33 is arranged to act against the transfer band to prevent the paper web from travelling around the transfer band loop and also to clean the transfer band. The web is scraped off the transfer band 30 by means of the doctor 33, e.g., if the suction roll 26 fails to transfer the web to the drying wire 25. A washing/lubricating jet device 33*a* is arranged before the doctor 33 in the running direction of the transfer band and operates to provide a jet which washes and lubricates the transfer band thereby reducing wear of the transfer band and the doctor 33 and makes the cleaning operation provided by the doctor 33 more efficient. The device 33*a* is preferably provided with spreading nozzles.

After the roll 33*a*, the run of the transfer band 30 continues to roll 32*b* which is spaced from roll 32*a* so as not to form a nip therebetween. A doctor 36 operates against the lower surface of the roll 32*b* to remove broke from the surface of the roll 32*b* and, if needed, to prevent the web from wrapping around roll 32*b*. After the roll 32*b*, the run of the transfer band fabric 30 continues to a tensioning roll 34 which turns the run of the transfer band loop upwards to guide roll 35. From guide roll 35, the transfer band fabric 30 runs further as a straight run into the second nip $N_2$.

A doctor 37 is arranged to act against the tensioning roll 34 to cleans the transfer band 30 and wipe the transfer band 30 dry before the transfer band 30 is passed into the press nips. A washing/lubricating jet device 37*a* is arranged before the doctor 37 in the running direction of the transfer band 30 and operates to provide a jet which washes and lubricates the transfer band. The device 37*a* serves to provide an oscillating high-pressure needle jet or a high-pressure jet provided with spreading nozzles. Although the jet usually consists of water, it is also possible to use chemicals in the jet to aid in the cleansing and conditioning of the transfer band 30.

The transfer suction roll 26 in the embodiment of FIG. 2A is constructed so as to enable variable negative pressures to be applied therein in a similar manner as described above with respect to the embodiment of FIG. 1A.

Figure 3A:
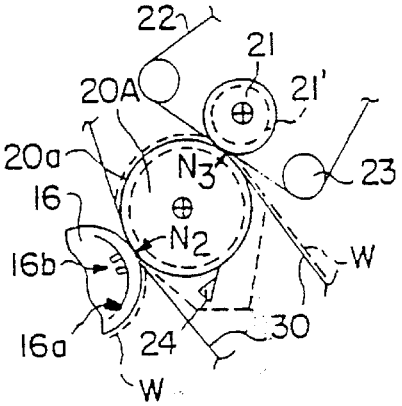
FIGS. 3A to 3H show different variations for various details of the press sections as shown in FIGS. 1, 1A, 2, 2A and 2B.

Referring now to FIGS. 2B and 3A, this embodiment is similar to that shown in FIG. 2A and the same reference numerals indicate the same elements. However, in this embodiment, center roll 20A has a hollow-face 20*a*, i.e., a grooved face or a blind-drilled face, and the transfer band fabric 30 is slightly permeable to water. As a result of the permeability of the transfer band 30 and the hollow-face 20*a* of the center roll 20A, water pressed in the press nips $N_2$, $N_3$ is removed through the transfer band 30 and into the center roll 20A. Water is also passed into the transfer band 30 during its run between the nips $N_2$, $N_3$. The web thus has a higher dry solids content when it is transferred from the transfer band 30 into the drying section. On the sector of the center roll 20A that is free from the band 30, a trough 36 is arranged to gather water and contaminants. The roll face 20*a* is kept clean by a cleaning doctor 24.

The existence of the hollow-faced 20*a* center roll 20A is that the hollow face 20*a* enables the internal water pressure of the slightly permeable transfer band 30 to be reduced in the nips $N_2$, $N_3$ and the risk of delamination to be diminished. Moreover, the presence of the hollow faced 20*a* center roll 20A enables a reduction in air bag formation in front of the press nips $N_2$, $N_3$ between the transfer band 30 and the center roll 20A. Such air bags make the transfer band 30 baggy and lift it out of contact with the center roll 20A. This situation is especially prevalent when the transfer band 30 is impermeable on the side facing the paper and porous on the side facing the roll.

As shown in FIG. 2B, lubricating water is applied by a water jet 38*a* to the face of the center roll 20A after the transfer band has been detached therefrom. Doctor 24 is arranged before the water jet 38*a* and a second doctor may be used so that the water jet is arranged between two doctors. The application of lubricating water serves to prevent the formation of water bags before the nips and can be applied regardless of whether the center roll is a hollow-faced 20*a* center roll 20A as shown in FIG. 2B or a smooth-faced center roll as shown in FIGS. 1A and 2A. A lubricating water jet 38*b* may also be applied on the run of the transfer band 30 immediately before the web is passed thereto to run over the center roll 20A.

To provide adjustment of the contact angle $\alpha$ between the transfer suction roll 26 and the run of the transfer band 30, both the transfer suction roll 26 and leading roll 32*a* are arranged to be movable, e.g., by conventional actuators such as hydraulic or pneumatic cylinders. Leading roll 32*a* is the first roll over which the transfer band 30 runs after the web has separated therefrom. In this manner, it is possible to move transfer suction roll 26 and/or the leading roll 32*a*, i.e., relative to one another, to obtain the desired contact angle $\alpha$. The transfer suction roll 26 is moved closer to the transfer band 30 during threading operations, and away from the transfer band 30 after the threading is complete and during continuous running of the paper machine. The reduction of the contact angle, i.e., movement of the transfer suction roll 26 away from the transfer band 30, helps to maintain the speed difference between the transfer band 30 and the drying wire 25. In addition, lowering the level of negative pressure in the transfer suction roll 26 also helps maintain the speed difference.

This embodiment further comprises means for causing the paper web to adhere to the face of the first drying cylinder 28 in the drying section. This is important because when the tail of a paper web is passed from the wire section to the press section, the full width of the web is then passed from the press section, with the help of the transfer suction roll 26, to the face of the drying wire 25 and runs thereon until it engages with a doctor 28*b*. At the doctor 28*b*, the web is passed down into a pulper or to a broke conveyor (not shown). In order for the narrow leader which is separated from the web by means of a water jet in the wire section or on the lower surface of the pick-up felt 14 to be guided to the drying section, the web must adhere to the face of the first drying cylinder 28 as far as the doctor 28*b* from which the leader is blown forward onto the drying wire 25.

To ensure that the web adheres to the face of the first drying cylinder 28, the drying cylinder 28 may be heated by conventional heating means, e.g., steam or infrared heaters, to increase adhesion of the web thereto. The surface temperature of the drying cylinder 28 is preferably regulated independently of the temperature of the other drying cylinders. Another way to increase adhesion of the web to the face of the drying cylinder 82 is to apply or spray chemicals and/or water on the face of the drying cylinder 28 via water jet means 28*c* which can be arranged before or after the doctor 28*b* or between two successively arranged doctors.

In the following, with reference to FIGS. 3B to 3H, different variations will be described for various components of the invention.

Figure 3B:
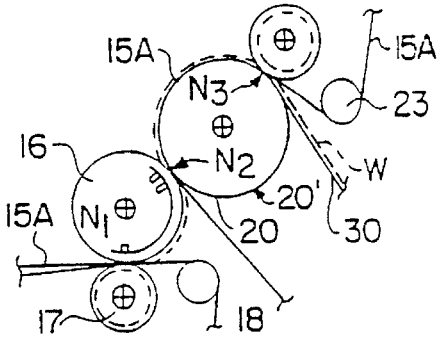

In FIG. 3B, the pick-up felt 15A runs through all of the three subsequent press nips $N_1$, $N_2$ and $N_3$ and operates in them as a press fabric that received water. This construction provides the advantage that, between the nips $N_2$ and $N_3$, the pick-up felt 15A presses the web W against the outer face of the band 30. In this manner, separation of the web W from the face of the band 30 between the nips $N_2$ and $N_3$ is prevented even with a very little adhesion. The arrangement shown in FIG. 3B can also be applied in a press of the Sym-Press-O™ type shown in FIG. 2.

In this embodiment, a closed loop of the pick-up felt 15A is passed around the center roll 20 whereby the web is carried between the outer face of the pick-up felt 15A and the outer face of the transfer band 30 through the press nip $N_2$. Then, the web is carried around the center roll to the press nip $N_3$. The web is detached from the pick-up felt after press nip $N_3$.

Figure 3C:
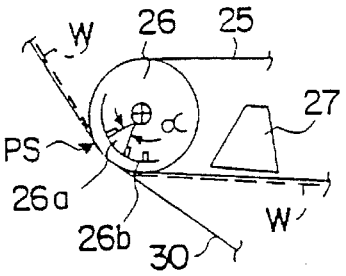

FIGS. 3C, 3D, 3E and 3F some alternative solutions by whose means it is ensured that the web W can be detached reliably from the outer face of the transfer band fabric 30 and transferred onto the drying wire 25. As shown in FIG. 3C, the transfer suction roll 26 has a transfer zone PS between the wire 25 and the fabric 30 on the suction zone 26*a* of the suction roll 26. The magnitude $\alpha$ of the zone 26*a* is preferably arranged adjustable in the range from about 0° to about 45°, preferably in the range from about 5° to about 20°. By means of regulation of the angle $\alpha$, it is partly possible to optimize the transfer of the web. In the first zone 26*a* in the suction roll, there is a negative pressure, which is generally at the level of from about 0.1 bar to about 0.7 bar. In the next zone 26*b*, there is a lower negative pressure that ensures the transfer, the negative pressure being generally in the range from about 0.05 bar to about 0.4 bar.

Figure 3D:
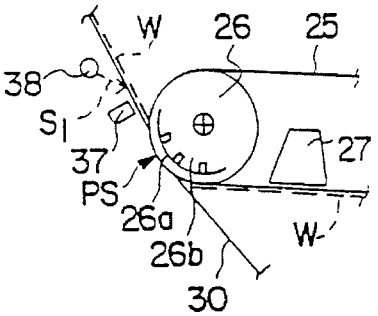

As shown in FIG. 3D, before the transfer zone, a bending shoe 37 is placed against the inner face of the transfer band fabric, which shoe 37 is preceded by water jet means 38. The area between the inner face of the transfer fabric 30 and the curved guide face of the bending shoe 37 is lubricated by means of water jets $S_1$ applied from the water jet means 38. Owing to the guide face of the shoe 37, detaching forces, which arise from a slight difference in velocity, are produced between the outer face of the transfer fabric 30 and the web W.

In connection with, or instead of, the shoe 37, it is possible to employ ultrasonic oscillators, by means of whose energy impulses the contact between the web W and the outer face of the band 30 is shaken to make it more favorable for the transfer onto the drying wire 25.

Figure 3E:
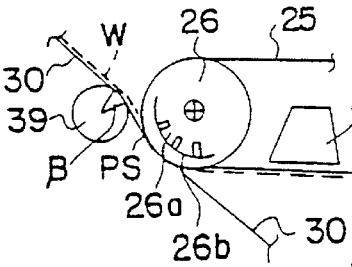

As shown in FIG. 3E, the bending shoe 37 as shown in FIG. 3D is substituted for by a corresponding revolving guide roll 39, by means of whose sector $\beta$ an effect is produced that corresponds to that produced by the bending shoe 37.

Figure 3F:
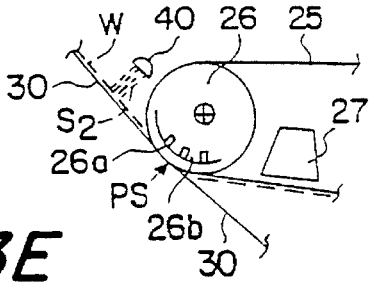

In FIG. 3F, before the transfer zone PS of the transfer suction roll 26, at the proximity of the web W, an infrared heater 40 is arranged. By means of radiation $S_2$ produced by the heater 40, the temperature of the water present in the web W is raised in particular, whereby the separation of the web from the outer face of the transfer band fabric 30 is promoted.

Figure 3G:
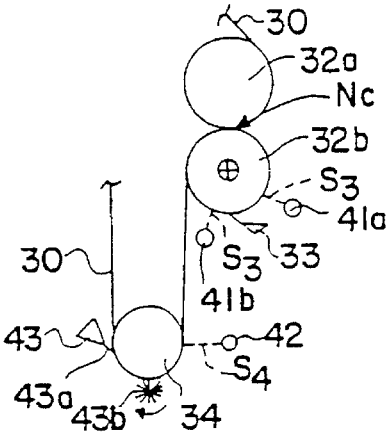

FIG. 3G shows a safety and/or cleaning nip $N_c$ operating on the loop of the transfer band fabric 30 and formed between the rolls 33*a* and 32*b*. The lower roll 32*b* is provided with a drive gear, and the properties of its surface are chosen so that, should the web W follow the face of the transfer band fabric 30, it adheres to the roll face 32*b*, from which it is detached by means of the doctor 33 and transferred into the pulpar placed underneath. The cleaning roll 32*b* has a considerable sector of contact with the transfer fabric 30. The bending of the transfer band fabric in opposite directions with relatively short curve radii, taking place on the rolls 32*a* and 32*b*, promotes the cleaning quality of the transfer band fabric 30 considerably. Moreover, the face of the roll 32*b* is chosen such that impurities adhere to this face, from which they are detached and washed by means of water jets and/or chemical jets $S_3$ applied from the jet pipes 31*a* and 31*b*. The lower roll 32*b* is preferably a roll provided with a smooth face that makes the web adhere to the roll, for example a rubber-faced, a Dynarock™-faced or a Mikrorock™-faced roll. The nip load in the nip $N_c$ is preferably in the range from about 5 to about 30 kN/m. The safety function of the nip $N_c$ is of particular importance with certain pulp raw-materials which are even highly contaminating.

Figure 3H:
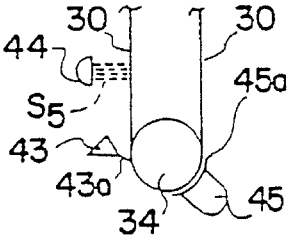

In FIG. 3H, the transfer band fabric 30 is heated at the level of the tensioning roll 34 by means of steam jets applied from the steam box 45 into the treatment gap 45*a*. Moreover, according to FIG. 3H, the fabric 30 is heated by means of radiation $S_5$ applied from an infrared radiator 44. In this way, the temperature level of the fabric loop 30 is raised, the cleaning is intensified, and thermal energy is transferred by the intermediate of the fabric 30 to act in the press nips $N_2$and $N_3$ to promote the dewatering of the web W by means of mechanisms known per se.

With respect to details of the structure and properties of the transfer band fabric 30 in accordance with the invention, reference is made to the assignee's FI Patent Applications Nos. 823187 and 842114, corresponding to U.S. Pat. Nos. 4,526,655 and 4,976,821, respectively (also assigned to the assignee and the specifications of which are hereby incorporated by reference herein), in which various band-like transfer fabrics are described, which can be applied as a transfer band fabric 30 in the present invention, at least after certain modifications.

If necessary, the press sections in accordance with FIGS. 1, 1A, 2 and 2A may also be employed as conventional press sections with open draw when the running speed of the paper machine and/or the strength of the paper web do not require a closed draw. The conversion to conventional press sections is carried out by removing the transfer band 30 and by shifting either the transfer suction roll 26 alone (arrow A) or the transfer suction roll 26 and the suction boxes 27 to the optimal distance (e.g., from about 20 mm to about 120 mm) from the center roll 20 that is required by an open draw of the paper web W. Such a shifting can be carried out, e.g., by means of hydraulic or pneumatic cylinders.

The alternative embodiments shown in FIGS. 3A–3H can be applied independently or in combination with each other, if possible, in the press sections shown in FIGS. 1, 1A, 2, 2A and 2B.

In the following, the patent claims will be given, and the various details of the invention may show variation within the scope of the inventive idea defined in the claims and differ from the details described above by way of example alone.

What is claimed is:

1. A press section in a paper machine, comprising a compact combination of press rolls defining press nips with each other, one of the press rolls being a center roll, a plurality of fabrics for supporting a web in its run through said press section, one of said fabrics comprising a transfer band running a closed loop around said center roll and having an outer face upon which the web is supported, means for transferring the web from said transfer band in a transfer zone after said at least one press nip as a fully closed draw onto a drying wire or press fabric, said web transferring means comprising a suction roll located after said center roll in the running direction of the web, means for preventing the web from remaining on said transfer band after said transfer zone, means for cleaning said outer face of said transfer band, and deflecting means located in said run of the web through the press section in proximity to said suction roll, the web being deflected by said deflecting means in conjunction with said suction roll, said deflecting means comprising a guide shoe or a guide roll located immediately before said transfer zone by whose means the detaching of the web from said outer face of said transfer band and the transfer of the web as a closed draw onto said drying wire or onto said press fabric are promoted.

2. The press section of claim 1, further comprising a leading roll situated inside said transfer band loop, and means for adjusting a contact angle defined between said transfer band and said suction roll, said adjusting means comprising displacement means for moving said suction roll.

3. The press section of claim 1, further comprising an intermediate frame, said center roll being mounted on said intermediate frame by means of fixed bearing supports, said intermediate frame being cantilevered and provided with detachable intermediate pieces for quick replacement of said transfer band loop.

4. The press section of claim 1, wherein said center roll comprises a smooth cylindrical mantle and said transfer band comprises a fabric which substantially does not receive water and does not rewet the web, further comprising cleaning means for cleaning a face of said center roll and collecting means for collecting water and impurities, said cleaning means and said collecting means located on a sector of said center roll free from said transfer band.

5. The press section of claim 1, further comprising first heating means arranged immediately before said transfer zone to promote detaching of the web from said outer face of said transfer band and transfer of the web as a closed draw onto said drying wire or onto an equivalent transfer fabric, and second heating means arranged in connection with said transfer band loop, said second heating means structured and arranged to improve cleaning of said transfer band loop and dewatering of the web in said press nip.

6. The press section of claim 1, further comprising a front frame part, a rear frame part, intermediate frame parts attached on said front frame part and on said rear frame part by means of horizontal articulated joints, a first press roll defining first press nip with said center roll, a second press roll defining a second press nip with said center roll before said first press nip, said second press roll being mounted on said intermediate frame parts, and said first press roll being mounted on other intermediate frame parts attached to said rear frame part, said intermediate frame parts being openable by means of actuators so that a space between said front frame part and said rear frame part is open or quickly openable at a top of said press section, wherein press rolls in said compact combination of rolls placed in the area of said space can be replaced by lifting them substantially straight upwards by means of a crane mounted on a ceiling.

7. The press section of claim 1, wherein said center roll is a hollow-faced center roll and said transfer band is partially permeable to water such that water is removed from the web through said transfer band into said hollow-faced center roll.

8. The press section of claim 1, wherein the drying wire or press fabric to which the web is transferred from said transfer band is guided over said suction roll such that the web is first brought into engagement with the drying wire or press fabric over said suction roll.

9. The press section of claim 1, wherein said deflecting means comprise a guide shoe having a surface situated against an inner face of said transfer band.

10. The press section of claim 1, wherein said deflecting means comprise a rotating guide roll having a surface engaging with an inner face of said transfer band.

11. An arrangement in a paper machine, comprising a press section including a compact combination of press mils defining press nips with each other, one of said press rolls being a center roll, a plurality of fabrics for supporting a web in its run through said press section, one of said fabrics comprising a transfer band running a closed loop around said center roll and having an outer face upon which the web is supported, and means for transferring the web from said transfer band in a transfer zone after said at least one press nip as a fully closed draw onto a drying wire, said web transferring means comprising a suction roll located after said center roll in the running direction of the web, means for preventing the web from remaining on said transfer band after said transfer zone, means for cleaning said outer face of said transfer band, and deflecting means located in said run of the web through the press section in proximity to said suction roll, the web being deflected by said deflecting means in conjunction with said suction roll, said deflecting means comprising a guide shoe or a guide roll located immediately before said transfer zone by whose means the detaching of the web from said outer face of said transfer band and the transfer of the web as a closed draw onto said drying wire or onto said press fabric are promoted, a drying section following said press section and comprising a first drying cylinder in the running direction of said drying wire, said drying wire carrying the web into contact with a face of said drying cylinder and means for causing the web to adhere to said face of said drying cylinder until the web travels to said doctor, said adhesion means comprising heating means for heating said drying cylinder.

12. A method for dewatering a web in a paper machine including a press section and a drying section, the press section comprising a compact combination of press rolls defining press nips with each other, one of said press rolls being a center roll and a plurality of fabrics for supporting a web in its run through said press section, comprising the steps of:

carrying the web on an outer face of a transfer band running a closed loop around said center roll, arranging a suction roll after said at least one press nip in the running direction of said transfer band, transferring the web from said outer face of said transfer band after said at least one press nip in a transfer zone as a fully closed draw onto a drying wire in proximity to said suction roll, promoting detaching of the web from said outer face of said transfer band and the transfer of the web as a fully closed draw onto the drying wire by arranging deflecting means immediately before said transfer zone in proximity to said suction roll, the web being deflected by said deflecting means in conjunction with said suction roll, said deflecting means comprising a guide shoe or a guide roll, doctoring said outer face of said transfer band to prevent the web from remaining on said transfer band after said transfer zone and to clean said outer face of said transfer band, arranging a leading roll inside said transfer band loop, and adjusting a contact angle defined between said transfer band and said suction roll by moving said suction roll.

13. The method of claim 12, further comprising the steps of transferring the web in said transfer zone to a drying wire, carrying the web on said drying wire into contact with a face of a drying cylinder in said drying section, doctoring said face of said drying cylinder on a sector of said drying cylinder free from said drying wire, and causing the web to adhere to said face of said drying cylinder until the web travels to said doctor.

* * * * *